United States Patent [19]

McCandless

[11] 4,455,976

[45] Jun. 26, 1984

[54] INTERNAL COMBUSTION ENGINES

[76] Inventor: John H. McCandless, 2724 San Rae Dr., Kettering, Ohio 45419

[21] Appl. No.: 366,045

[22] Filed: Apr. 6, 1982

[51] Int. Cl.[3] ..... F02B 1/00; F01L 7/00

[52] U.S. Cl. ..... 123/197 A; 123/197 R; 123/197 AB; 123/57 R; 123/81 R; 123/81 C; 123/190 DA

[58] Field of Search ..... 123/197 A, 197 AB, 197 R, 123/57 R, 57 A, 78 E, 585, 81 R, 81 B, 81 D, 81 C, 90.6, 90.48, 190 D, 190 DA, 54 R, 54 A, 54 B

[56] References Cited

U.S. PATENT DOCUMENTS

| | | | |
|---|---|---|---|
| 1,177,428 | 3/1916 | Melin | 123/90.6 |
| 1,281,981 | 10/1918 | Krienitz | 123/57 A |
| 2,926,640 | 3/1960 | Aspin | 123/190 D |
| 4,270,495 | 6/1981 | Freudenstein et al. | 123/78 E |
| 4,345,550 | 8/1982 | Finley | 123/78 E |

FOREIGN PATENT DOCUMENTS

| | | | |
|---|---|---|---|
| 348989 | 5/1905 | France | 123/78 E |
| 5097291 | 2/1977 | Japan | 123/197 AB |
| 605040 | 5/1978 | U.S.S.R. | 123/585 |

*Primary Examiner*—Craig R. Feinberg
*Assistant Examiner*—David A. Okonsky

[57] ABSTRACT

A four cycle internal combustion engine in which cylinders are arranged in pairs. The pistons in each pair of pistons are arranged to operate in tandem.

A U shaped arm which is arranged to turn around a center is connected through one set of linkages to a pair of pistons and through a second set of linkages to a crank. The center of rotation of the said U shaped arm is arranged to move around a center in a manner which will change the length of the stroke of the pistons without affecting the compression ratio.

A third "air pumping cylinder" is located midway between the two cylinders. This cylinder contains an "air pumping piston".

A cam operated rotary valve which is located in the top of the air pumping cylinder will be turned to an intake port during the down strokes of the air pumping piston and will permit air to be drawn in to this cylinder.

The rotary valve will be turned to a closed position during the up strokes of the air pumping piston. This will permit air to be compressed.

Near the top of the compression stroke, the rotary valve will be turned to a port which will conduct hot compressed air from the air pumping cylinder to a cylinder in which a fuel mixture has been compressed. This will create turbulence in this mixture and ignite this mixture.

The cycle will then repeat for the second cylinder.

1 Claim, 33 Drawing Figures

INTERNAL COMBUSTION ENGINES

FIELD OF THE INVENTION

This invention relates to a four cycle engine in which the length of the stroke can be changed. When a large amount of power is needed, the engine can be made to operate with a long stroke. When less power is needed, it will operate with a shorter stroke. Means have been provided for changing the length of the stroke without changing the compression ratio and for creating turbulance in the combustion chamber regardless of the length of the stroke or of the speed of the engine. Means have also been provided for keeping the timing of the engine constant without regard for the length of the stroke.

PRIOR ART

Internal combustion engines which are now in use are not efficient at low loads and they produce large quantities of carbon dioxide and other pollutants at low load. There are two principal reasons for this.

Cylinder wall friction consumes a large amount of energy. In some engines, nearly half of the energy produced by burning fuel is consumed as cylinder wall friction. In a conventional constant stroke engine, this loss occurs even when the engine is producing a small amount of power. Since a variable stroke engine will operate with a very short stroke when it is not producing much power, it should have much lower friction losses than a conventional constant stroke engine.

Internal combustion engines must burn a closely controlled mixture of about 14 pounds of air to a pound of fuel. It is not possible to reduce the amount of fuel being burned in such an engine without making a corresponding reduction in the amount of air being drawn into the engine. When these engines are operating at light loads, air and fuel mixtures are drawn into them under partial vacuums. Even after gases which are drawn into these engines at these low pressures are compressed, their preignition pressures are low. Engines will not operate efficiently at these low pressures because there is not enough air in the cylinders to expand and do work. Fuels will not burn completely at these low pressures because there is not enough oxygen to completely support combustion.

An engine which can reduce it's power by shortening it's stroke should be able to use air and fuel mixtures which are at a higher pressure than it is possible to attain in a constant stroke engine. Therefore such an engine should be more efficient and produce less pollution than a constant stroke engine.

All modern spark ignition engines are arranged with special cylinder heads which create turbulence in the burning gases. The gases are squeezed between the pistons and special surfaces on the cylinder heads in a manner which forces them out into the combustion chamber at high speeds and causes them to create turbulence. These surfaces are called "squish" surfaces. Although these methods are in general use, they are not very satisfactory because the squish occurs at the end of the stroke when the piston is barely moving. They barely work at all at low speeds.

By injecting very hot gases into the cylinders at the top of each compression stroke, it should be possible to get a great deal of turbulence and therefore good combustion at all strokes and speeds.

Other inventors have attempted to produce variable stroke engines. Most of these cause the timing of the engine to change with the stroke. Many of them cause the compression ratio to change with the stroke. None of them with which I am familiar produce turbulence in the combustion chamber.

This engine should solve problems which prior art has failed to solve. It should produce constant timing, a constant compression ratio, and the turbulence which is needed for efficient and clean combustion. It should be far more efficient and produce far less pollution than existing engines.

SUMMARY OF THE INVENTION

The invention consists of groups of two cylinders whose pistons are connected by connecting rods to two rocker arms which are either keyed to the same shaft or which are made integral with each other so that a motion of one piston will be duplicated exactly by the other. The rocker arms are connected by means of a connecting rod to a swinging arm which is in turn connected by linkages to a crank. The center of rotation of the swinging arm is located on an arm which is arranged to turn around a center so that the center of rotation of the swinging arm can be moved through a circular arc. This will cause the length of the stroke to change without changing the compression ratio. A means has been provided for injecting hot compressed air into the tops of the cylinders at the top of their compression strokes. This will produce combustion and create turbulence which is needed for efficient combustion. A link has been provided which will cause the crank to be in exactly the same positions at the end of the strokes reguardless of the length of the strokes. This will keep the timing of the engine constant for all strokes.

BRIEF DESCRIPTIONS OF THE DRAWINGS

Figure 6:
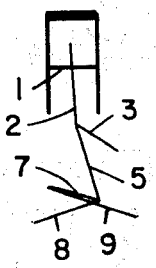

FIG. 6 os a line drawing showing the positions of the linkages when the pistons are at the top of a 3 inch stroke.

Figure 7:
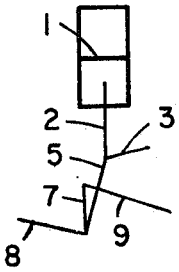

FIG. 7 is a line drawing showing the position of the linkages when the pistons are at the bottom of a 4 inch stroke.

Figure 8:
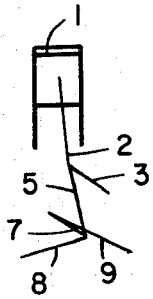

FIG. 8 is a line drawing showing the position of the linkages when the pistons are at the top of a 2 inch stroke.

Figure 9:
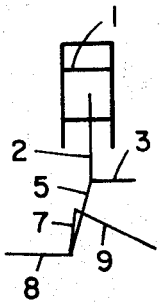

FIG. 9 is a line drawing showing the position of the linkages when the pistons are at the bottom of a 2 inch stroke.

Figure 10:
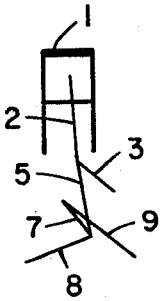

FIG. 10 is a line drawing showing the positions of the linkages when the pistons are at the top of a 1 inch stroke.

Figure 11:
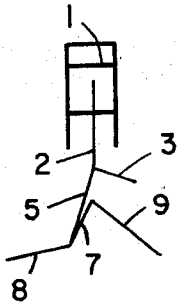

FIG. 11 is a line drawing showing the position of the linkages when the pistons are at the bottom of a 1 inch stroke.

Figure 2:
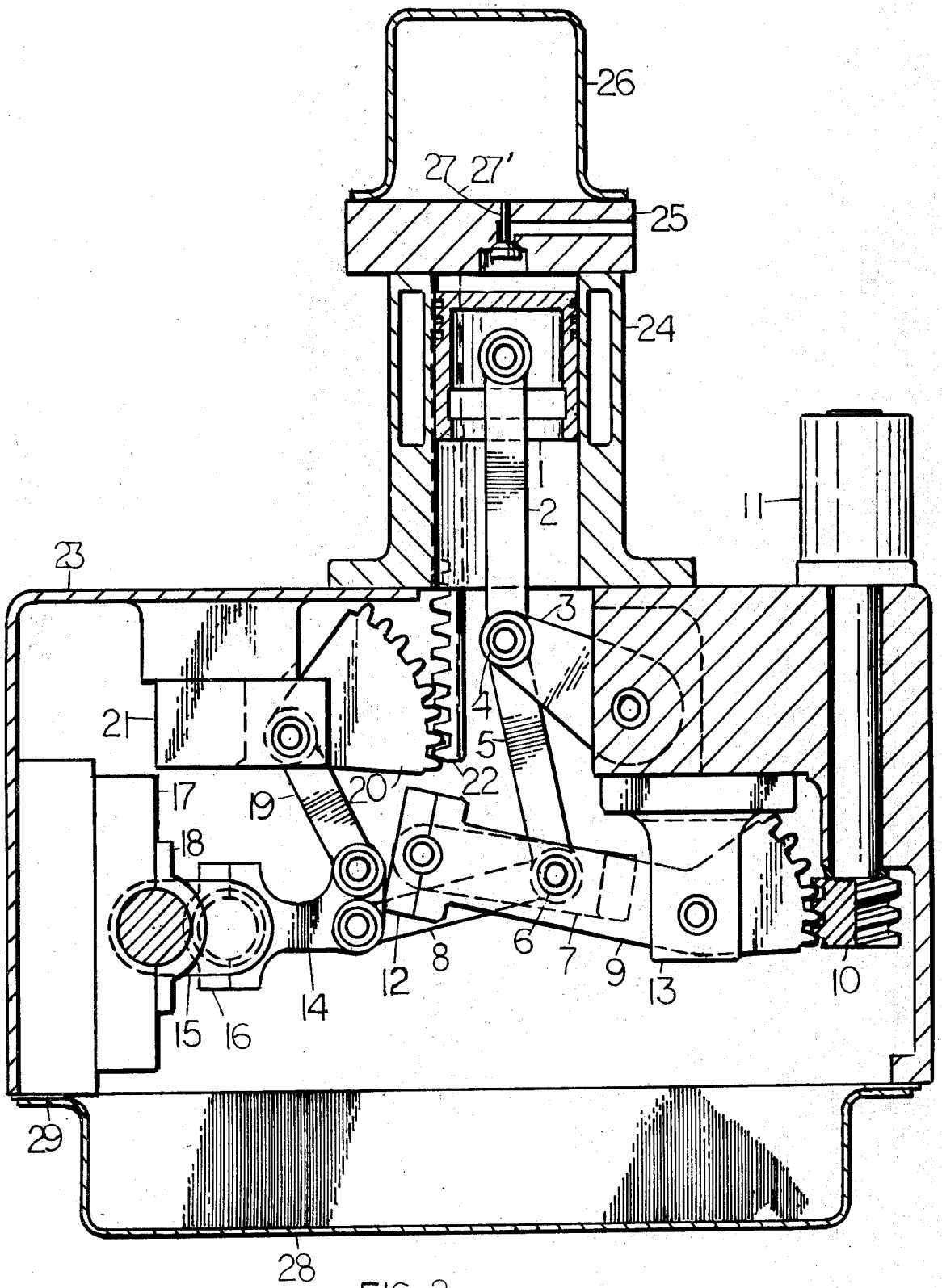
FIG. 2 shows a side view of the engine with the linkages at the top of a 4 inch stroke.
Figure 12:
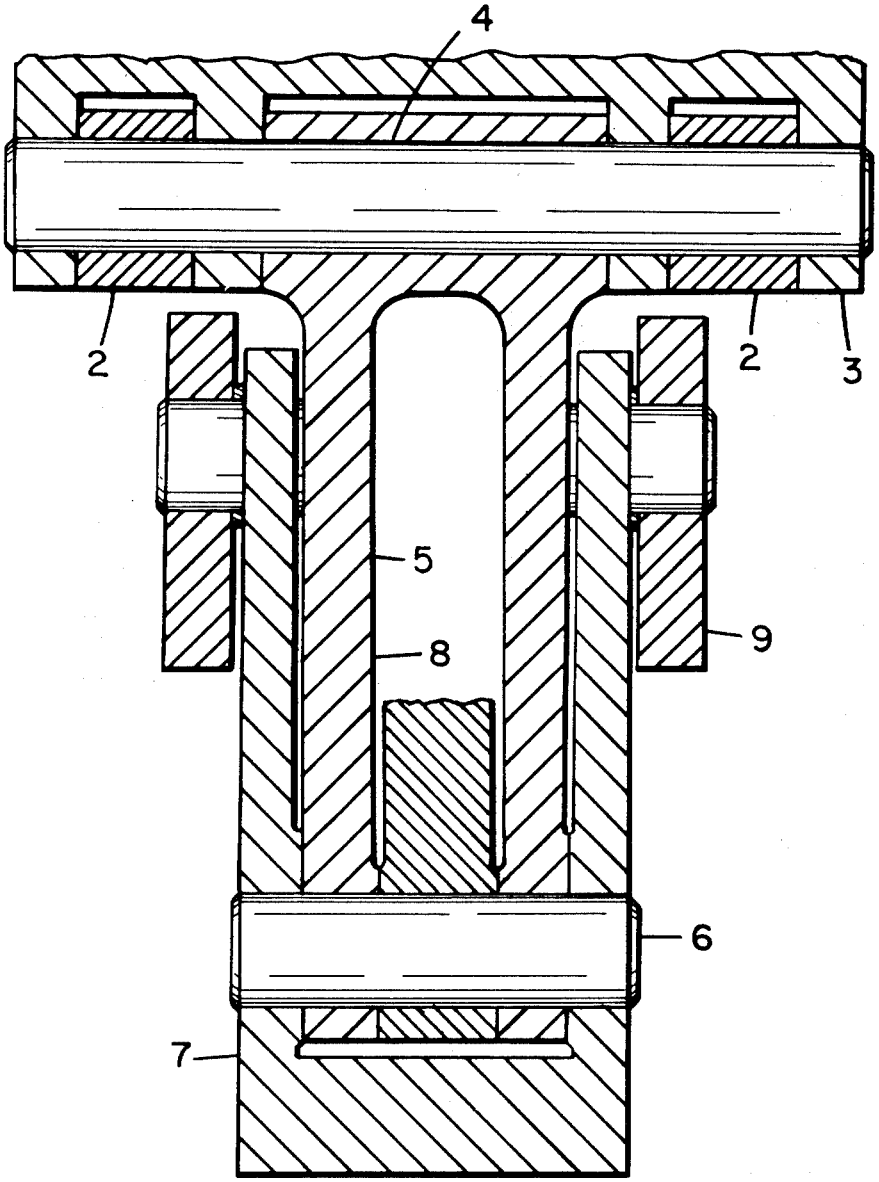

FIG. 12 shows a section of part of the linkages. This section is shown in FIG. 2 as section AA.

Figure 13:
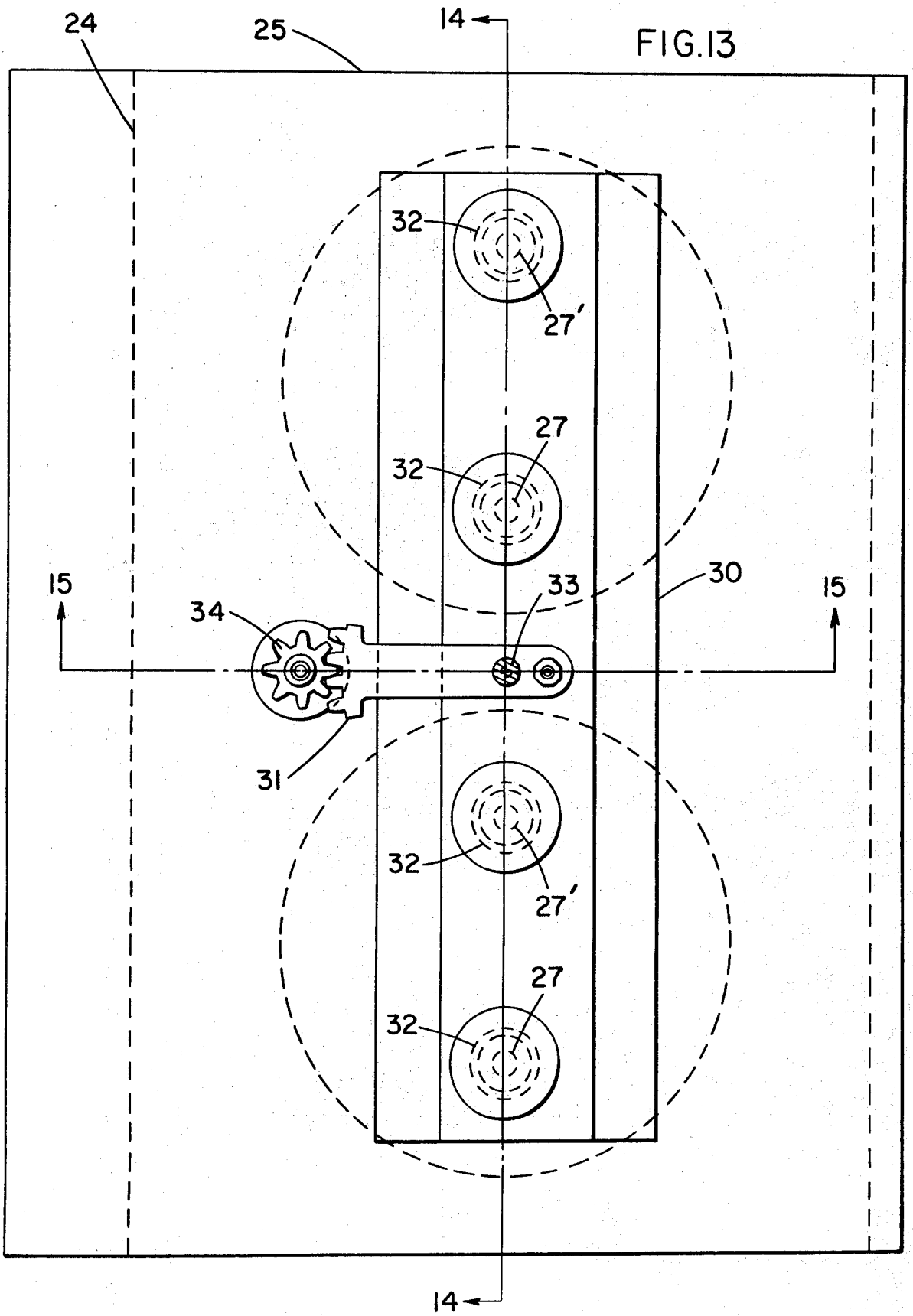

FIG. 13 shows a top view of the engine without the valve cover in place.

Figure 14:
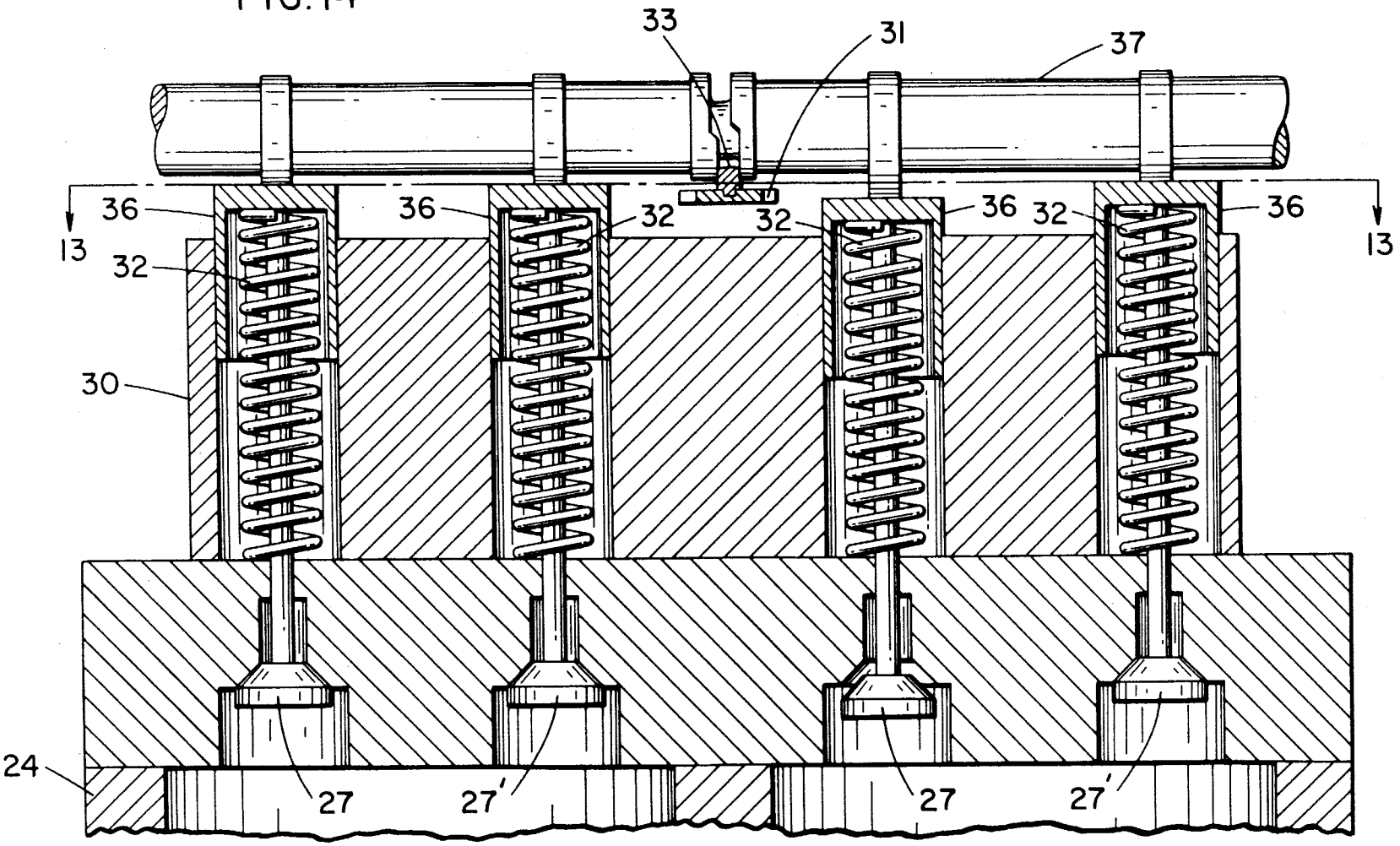

FIG. 14 shows a side view of the cylinder block assembly.

Figure 15:
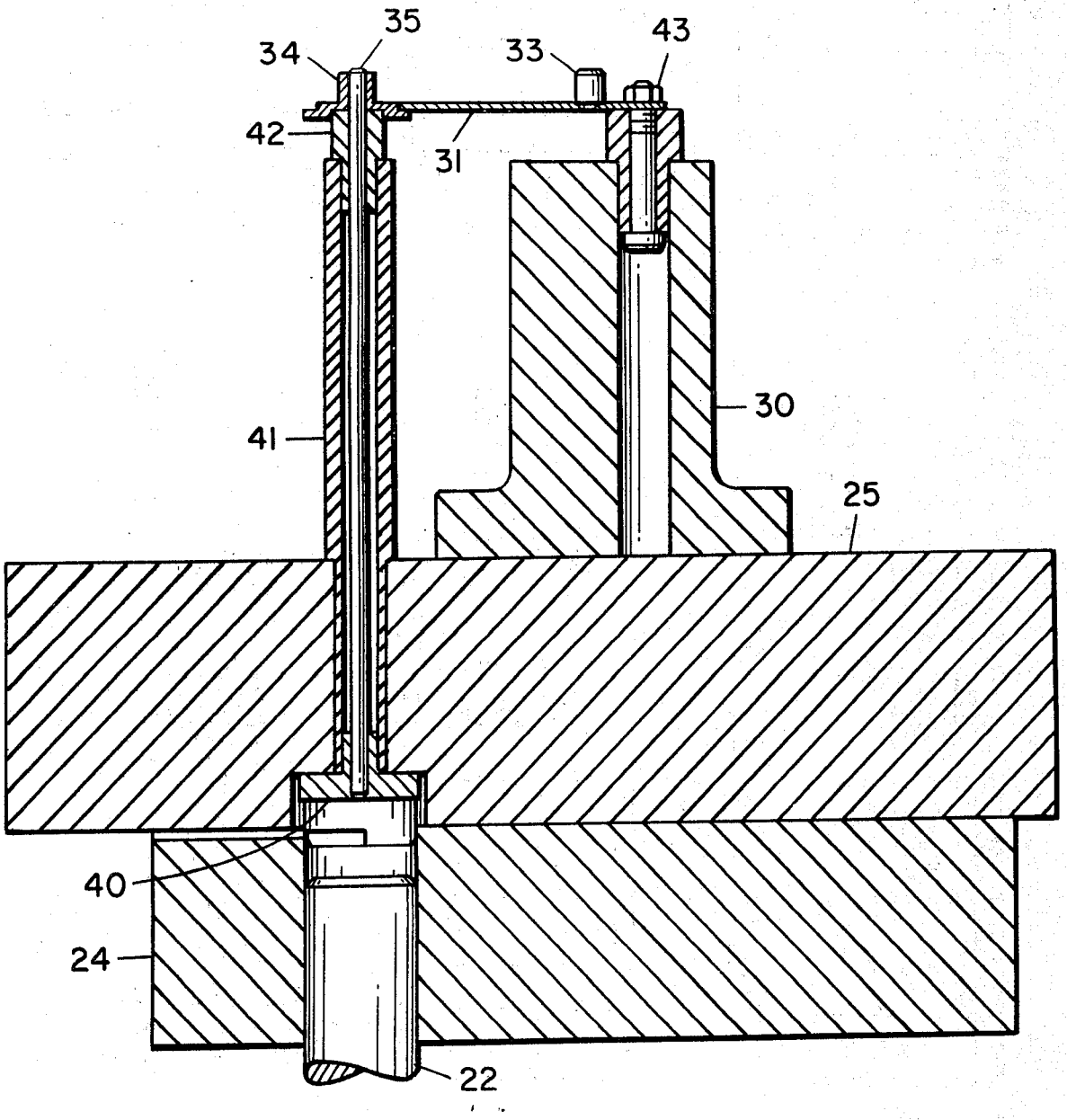

FIG. 15 shows a cross section of the engine. This cross section is shown in FIG. 13 as cross section CC.

FIGS. 16, 16A, 16B, 17, 17A, 17B, 18, 18A, 18B, 19, 19A, 19B, 20, 20A, 20B, 21, 21A, and 21B are line drawings which show the position of the linkages at the ends of various strokes.

DETAILED DESCRIPTION OF THE INVENTION

Figure 1:
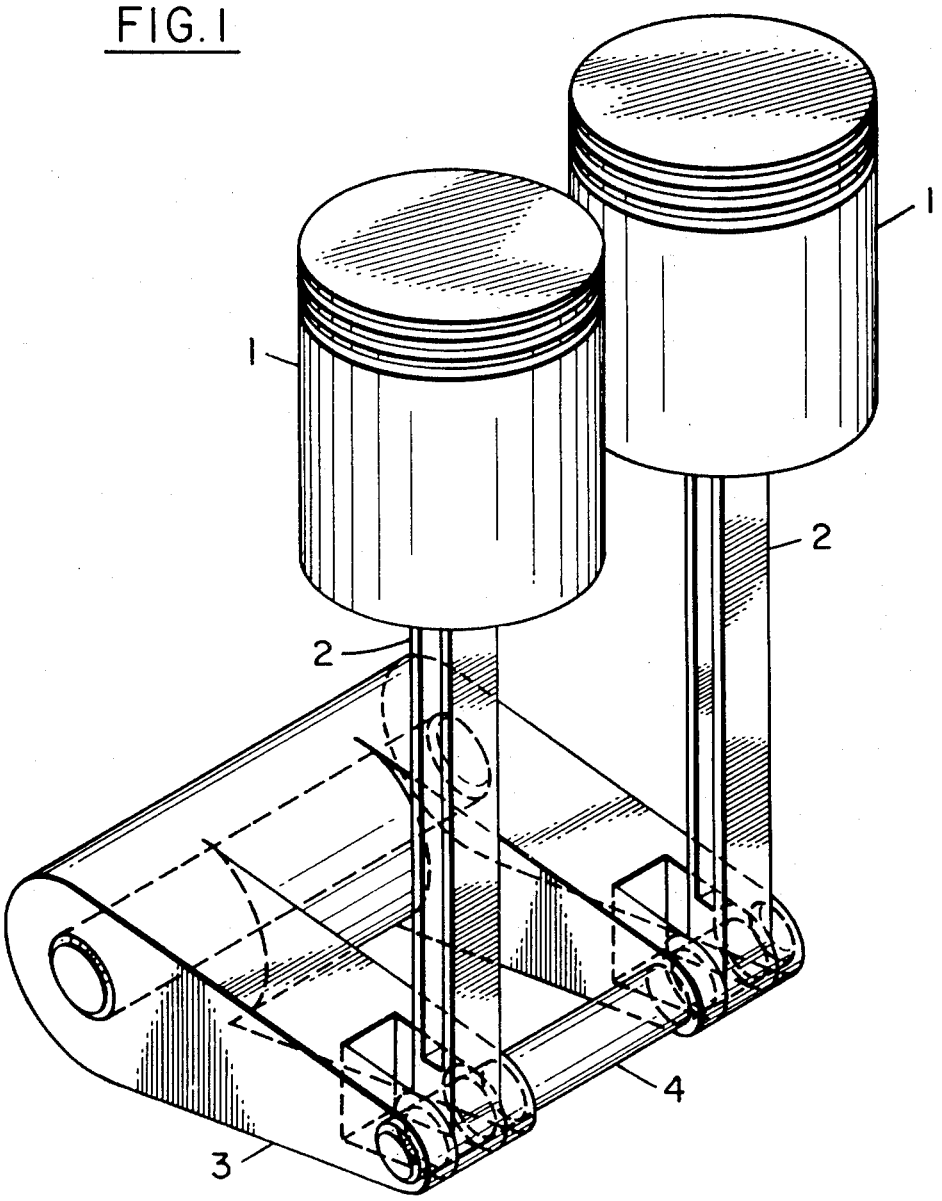
FIG. 1 shows an arrangement which can be used to cause two pistons to operate in tandem.

The Pistons Of the engine are arranged to operate in pairs. The pistons in each pair are arranged to operate in tandem. Any motion of one piston will be exactly duplicated by the other. FIG. 1 shows a method of causing two pistons to operate in tandem. Parts number 1 are pistons. The pistons are connected to parts number 2 which are connecting rods. The connecting rods are connected to part number 3 which is a double rocker arm device. FIG. 1 shows the said double rocker arm device as two rocker arms which are made integrally with each other. It could also consist of two rocker arms keyed to the same shaft. Part 4 is a shaft. It is obvious that any motion of one piston will be exactly duplicated by the other.

FIG. 2 shows a side view of the engine with the pistons at the top of a 4 inch stroke. A connecting rod (5) fis over a shaft (4) between the arms of the double rocker arm (3). This connecting rod (5) consists of two arms which are separated by a space and which are connected together where they fit over the shaft (4). It will be shown later that this construction is necessary to clear a part of an air injection system. It should now be apparent that there will not be excessive stresses on the double rocker arm (3). The connecting rod (2) will push downward with a strong force against the double rocker arm (3) and the shaft (4) but the other connecting rod (5) will push upward against these parts with an equal force.

A connecting rod (5) fits over a shaft which is part 6. this shaft is located in a U shaped arm which is part 7. This U shaped arm consists of two arms which are separated by a space and which are connected together at their left end as shown in FIG. 2.

Part 8 is a connecting rod whch fits over the shaft (6) between the arms of the U shaped arm (7).

Part 9 is a U shaped control arm or yoke. It consists of two arms which are separated by a space and which are connected together near their right ends as shown in FIG. 2. On one side of this U shaped arm (9) and at its right end as shown in FIG. 2 is a worm gear segment. This worm gear segment meshes with part 10 which is a worm gear. This worm gear (10) is connected to part 11 which is a reversable electric motor. The U shaped control arm (9) is arranged to turn on a shaft as shown and it has bearings on which arm number 7 can turn. Part 12 is a bearing cap which is screwed to the U shaped control arm (9). Part 13 is a post which supports the shaft of part 9. Part 14 is a connecting rod. Part 15 is a crank. Part 16 is a bearing cap which is screwed to the connecting rod (14). Part 17 is a bearing support block. Part 18 is a bearing cap which is fastened to the connecting rod (14). Part 19 is a swinging arm which will always cause the crank (15) to point directly to the right at the top of any stroke and to the left at the bottom of any stroke.

Part 20 is a spur gear segment which is connected to the swinging arm (19) so that it will turn with this swinging arm. Part 21 is a bearing support block. Part 22 is an air pumping piston which has rack teeth which will mesh with the teeth on the spur gear segment (20). Part 23 is a crank case. Part 24 is a cylinder block. Part 25 is a valve block. Part 26 is a valve housing. Parts 27 are exhaust valves. Parts 27' are intake valves. Part 28 is an oil pan. Part 29 is a gasket.

FIGS. 4 through 11 illustrate the operation of a mechanism which is used for producing a variable stroke. These figures will be discussed in detail under the heading of "operation".

Figure 3:
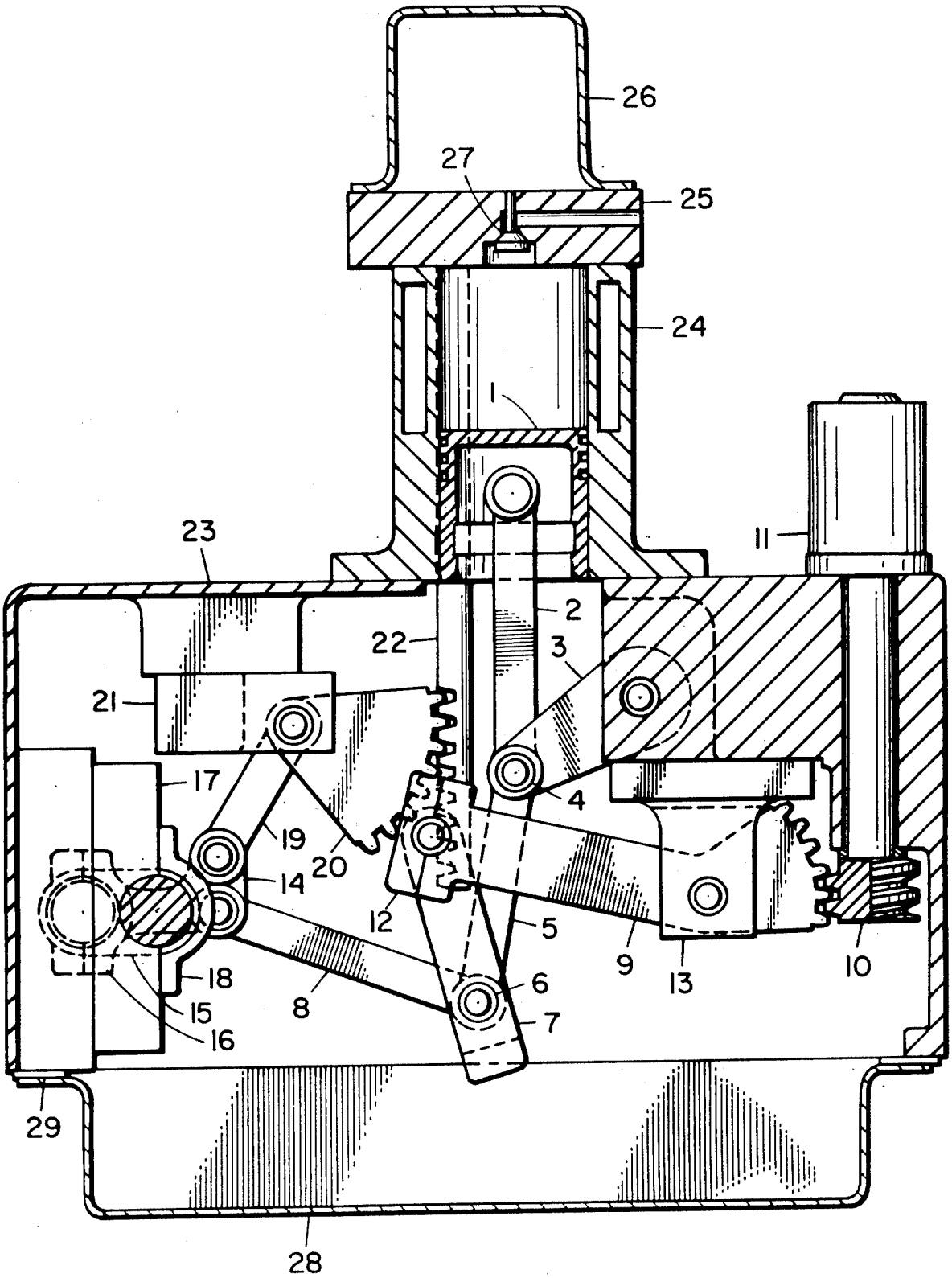
FIG. 3 shows a side view of the engine with the linkages at the bottom of a 4 inch stroke.

FIG. 12 shows a cross section of part of the linkages. This cross section is shown in FIG. 3 as section AA. In this figure, parts 2,3, and 4 are are the connecting rods, double rocker arm, and shaft which are shown in FIG. 1. Part 5 is the double connecting rod which was described in the description of FIG. 2. Part 5 turns on part 6 which is a shaft. Part 6 is located in part 7 which is a U shaped arm. Part 7 has two arms which are fastened together at one end and which has shafts near the other end. Part 8 is a connecting rod which fits over part 6 between the arms of part 7. Part 9 is a control link. It consists of two arms which are connected together near the right end in FIG. 2 and which have bearings near the opposite end. The shafts of part 7 fit in these bearings.

FIG. 13 shows the top view of the valve assembly. It has been drawn full size. Parts 24,25,27, and 27' are the cylinder block, the valve block, the exhaust valves, and the intake valves respectively. Part 30 is a valve spring retainer block. Part 31 is a gear segment. Parts 32 are valve tappets. Part 33 is a cam follower rod which is fastened to part 31. Part 34 is a spur gear which is fastened to part 35 which is a rotary valve.

FIG. 14 shows a vertical cross section of the valve assembly. this section is shown in FIG. 13 as section BB. Parts 25,27,27',30,31, 32, and 33 are the valve block, the exhaust valves, the intake valves, the valve spring retainer block, the gear segment, the valve tappets, and the cam follower respectively. They were described on previous sheets. Parts 36 are valve springs. Part 37 is a cam shaft.

FIG. 15 shows a cross section of the air injection assembly. This section is shown in FIG. 13 as section CC. Part 22 is the air pumping piston which was shown in FIGS. 2 and 3. Parts 24,25,30,31,33, 34,35,38,39,40,41,42, and 43 are a cylinder block, the valve block, the valve spring retainer block, the gear segment, the cam follower rod, the spur gear, the rotary valve, a bearing, a shaft, another bearing, and a hex nut respectively. FIGS. 16 through 21 B describe the operation of the rotary valve. These figures will be discussed in detail under the heading of operations.

OPERATIONS

When the pistons (1) move downward in the cylinders, they cause the connecting rods (2) to move downward. This causes the double rocker arm device (3) to turn in a counter clockwise direction. This motion will cause the connecting rod (5) to move downward. This will cause the U shaped arm (7) to turn in a clockwise direction around bearings which are located in the U shaped arm (9). The lower end of the connecting rod (5) will then move in a circular arc and in a clockwise direction around the center of rotation of the U shaped arm (9). This will cause the connecting rods (8 and 14)

to move to the left which will cause the crank (15) to turn to the left.

The electric motor (11) is connected to contacts which are controlled by an accelerator pedal. The contacts and the accelerator pedal are not shown on the drawings. When the accelerator pedal is pushed down, contacts are closed which will cause the electric motor to turn in a direction which will cause the right end of the U shaped control arm (9) to tuun upward in a counter clockwise direction. This will cause the left end of the U shaped control arm (9) to turn downward in a counter clockwise direction. The center of rotation of the U shaped arm (7) will then move downward in a counter clockwise direction around the center of rotation of the U shaped control arm (9). This will cause the arc which is formed by the motion of the end of the U shaped arm (7) to become more and more nearly vertical and this will cause the stroke of the pistons to become longer and longer. If the accelerator pedal is allowed to move upward, other contacts will be closed which will cause the electric motor to turn in the opposite direction. This will cause the gear segment which is on the right end of the U shaped control arm (9) to turn in a clockwise direction. This will cause the center of rotation of the U shaped arm (7) to turn in a clockwise direction around the center of rotation of the U shaped control arm (9). This will cause the arc which is formed by the motion of the lower end of the connecting rod (5) to become more and more nearly horizontal. This will cause the length of the stroke of the piston to become shorter. From this, it can be seen that by turning the control arm (9) around it's center of rotation, it is possible to change the length of the stroke of the engine. The stresses in the links will be purely compressive and tensile stresses. There will be no bending stresses except some moderate bending stress in the shafts.

It can be shown mathematically or by using a series of layouts that the compression ratio of the engine can be held constant regardless of the length of the stroke. In order to accomplish this, it is necessary to properly calculate the length of the links. In this paper, this fact will be demonstrated by a series of layouts.

Figure 4:
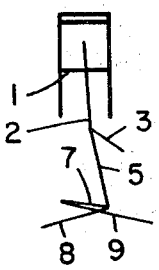
FIG. 4 is a line drawing of the linkages with the pistons at the top of a 4 inch stroke.

FIG. 4 shows the position of the linkages when the pistons are at the top of a 4 inch stroke. The drawings on this sheet are 1/10 full size. At this scale, there is $\frac{1}{2}$ inch of space between the tops of the pistons and the cylinder head. Arm 9 is shown at an angle of 10 degrees to the horizontal.

Figure 5:
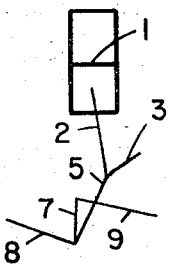
FIG. 5 is a line drawing showing the position of the linkages at the bottom of a 4 inch stroke.

FIG. 5 shows the position of the linkages when the pistons are at the bottom of a 4 inch stroke. There is $4\frac{1}{2}$ inches of space between the tops of the pistons and the cylinder heads. This gives a 9 to 1 compression ratio. Arm 9 is still at an angle of 9 degrees to the horizontal.

FIG. 6 shows the position of the linkages when the pistons are at the top of a 3 inch stroke. There is about $\frac{3}{8}$ of an inch of space between the tops of the pistons and the cylinder heads. Arm 9 makes an angle of about 16 degrees to the horizontal.

FIG. 7 shows the position of the linkages when the pistons are at the bottom of a 3 inch stroke. There is a space of 3 and $\frac{3}{8}$ inches between the tops of the pistons and the cylinder head. This still gives a 9 to 1 compression ratio. Arm 9 is still at an angle of about 16 degrees to the horizontal.

FIG. 8 shows the position of the linkages when the pistons are at the top of a 2 inch stroke. There is $\frac{1}{4}$ inch of space between the tops of the pistons and the cylinder heads. Part 9 makes an angle of about 25 degrees to the horizontal.

FIG. 9 shows the position of the linkages when the pistons are at the bottom of a 2 inch stroke. There is a space of $2\frac{1}{4}$ inches between the tops of the pistons and the cylinder head. This makes a 9 to 1 compression ratio. Part 9 is still at an angle of about 25 degrees to the horizontal.

FIG. 10 shows the position of the linkages when the pistons are at the top of a 1 ibch stroke. There is $\frac{1}{8}$ of an inch of space between the tops of the pistons and the cylinder head. Part 9 is at an angle of about 33 degrees to the horizontal.

FIG. 11 shows the position of the linkages when the pistons are at the bottom of a 1 inch stroke. Ther is land $\frac{1}{8}$ inch of space between the tops of the pistons and the cylinder heads. This gives a 9 to 1 compression ratio.

From FIGS. 4 through 11 it will be seen that the engine will maintain a constant compression ratio over a wide range of strokes.

As the pistons (1) move up and down, the swinging arm (19) will swing back and forth. This will cause the gear segment, (20) to turn up and down and this will cause the air pumping piston (22) to move up and down in the air pumping cylinder.

Two ports lead from the top of the air pumping cylinder to the combustion chambers of the cylinders in which pistons have been arranged to operate in tandem. A third port which is called an intake port leads to a source of air. These ports are shown in FIG. 13 as broken lines. The intake port is shown in FIG. 15 as a solid line. A rotary valve which is located in the top of the air pumping piston can be made to engage these ports. This rotary valve has part number 35. The rotary valve is connected to a spur gear which is part 34. This spur gear meshes with the teeth of a gear segment which is part 31. This gear segment is controlled by a cam follower rod which is part 33. The cam follower rod engages a cam slot in a cylindrical cam which is part of the cam shaft (37). As the cam slot moves from side to side, the cam follower (33) moves accordingly. This causes the gear segment (31) to move from side to side. This causes the gear (34) to turn which in turn causes the cylindrical valve (35) to turn.

The rotary valve (35) is arranged to cycle as follows. During the down stroke of the air pumping piston (35), the rotary valve will be turned to the intake port so that air will be drawn into the air pumping cylinder. During the up stroke of the air pumping piston, the rotary valve will be turned to a closed position so that air will be compressed in the air pumping cylinder to a very high pressure and temperature. Near the top of the up stroke of the air pumping cylinder, the rotary valve will turn momentarily to a port which leads to the combustion chamber of a cylinder in which a fuel and air mixture has been compressed. (Near the top of the compression stroke in this cylinder). This will permit hot, highly compressed air to spurt from the top of the air pumping cylinder to the combustion chamber of a cylinder in which gases have been compressed. The compressed air will create turbulence in these gases and ignite these gases. The rotary valve will then turn back to the intake port again and permit more air to be drawn into the air pumping cylinder during the down stroke of the air pumping piston. the rotary valve will then turn to a closed position so that air can be compressed in the air pumping cylinder during the up stroke of the air pumping piston. At the top of the stroke of the air pumping piston, the rotary valve will turn momentarily to the port which leads to the combustion chamber of the second cylinder and the cycle will repeat.

Figure 16:
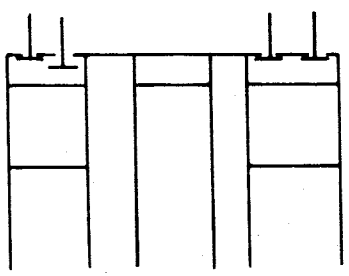
Figure 16A:
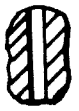
Figure 16B:
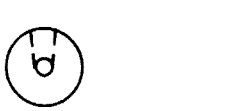

FIG. 16 shows the position of the pistons and valves at the beginning of a down stroke. The left hand cylinder is starting it's intake stroke; it's intake valve is open and it's exhaust valve is closed. FIG. 16A shows that the cam slot is straight during this stroke so that the rotary valve will remain open during this stroke. FIG. 16B shows that the rotary valve is turned to the intake port during this stroke. The right hand cylinder is starting it's power stroke so both of it's valves are closed. The air pumping cylinder is shown in the middle.

Figure 17:
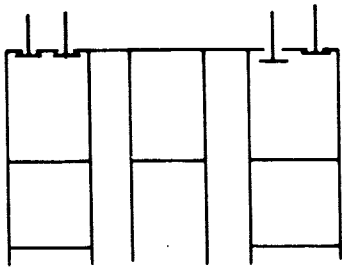
Figure 17A:
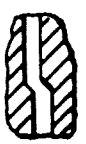
Figure 17B:
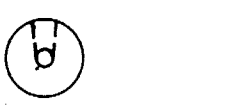

FIG. 17 shows the positions of the pistons and valves at the beginning of an up stroke. The left hand piston is beginning a compression stroke so both of it's valves are closed. The right hand cylinder is beginning an exhaust stroke so it's exhaust valve is open but it's intake valve is closed. The cam slot has turned the rotary valve to a closed position as is shown in FIGS. 17A and 17B.

Figure 18:
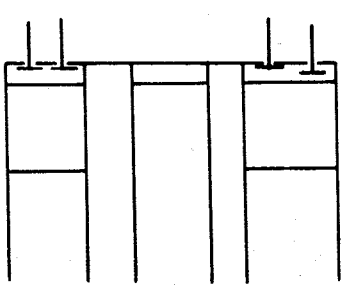
Figure 18A:
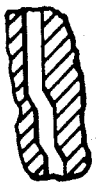

FIG. 18 shows the position of the pistons and valves at the top of a stroke. The cam slot which is shown in FIG. 18A has caused the rotary valve to turn to the position shown in FIG. 18B. The air pumping cylinder is shown as the middle cylinder. In FIG. 18A, the rotary valve is shown turned to a port which permits hot compressed air to spurt from the top of the air pumping cylinder to the top of the left hand cylinder. Since this left hand cylinder has just completed a compression stroke, it's combustion chamber is filled with a compressed air and fuel mixture. The hot compressed air spurts into this fuel mixture so rapidly that it creates a great deal of turbulence in this mixture. Since the compressed air is ver hot it ignites the mixture.

Figure 18B:
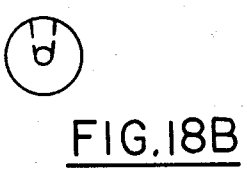
Figure 19:
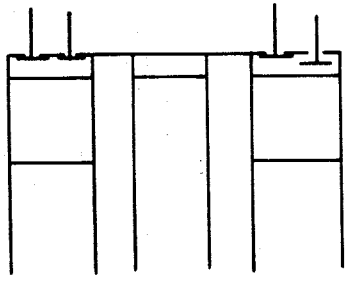
Figure 19A:
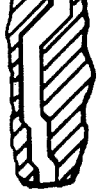
Figure 19B:
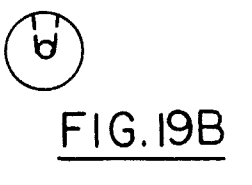

After the rotary valve has turned momentarily to the position shown in FIG. 18B, it turns to the position shown in FIG. 19B. In this position it connects to the intake port which permits air to be drawn into the air pumping cylinder. The pistons then make a down stroke. The left hand cylinder then makes a power stroke so it's valves are closed. The middle cylinder which is the air pumping cylinder, will make an intake stroke so air will be drawn into this cylinder. The right hand cylinder will make an intake stroke so it's intake valve is open but it's exhaust valve is closed.

Figure 20:
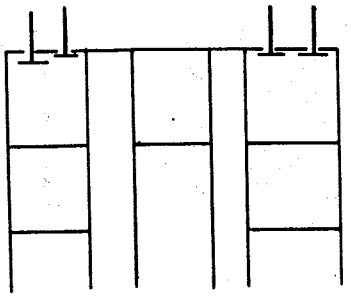
Figure 20A:
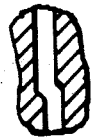
Figure 20B:
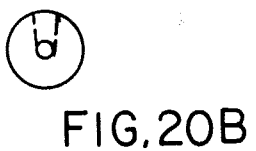

FIG. 20 shows the position of the pistons and valves at the bottom of a stroke when the pistons are ready to make an up stroke. The left hand cylinder will now make an exhaust stroke so it's exhaust valve is open but it's intake valve is closed. The middle air pumping cylinder will make a compression stroke so the cam slot which is shown in FIG. 20A causes the rotary valve which is shown in FIG. 20B to turn to a closed position. The right hand cylinder will engage in a compression stroke so both of it's valves are closed.

Figure 21:
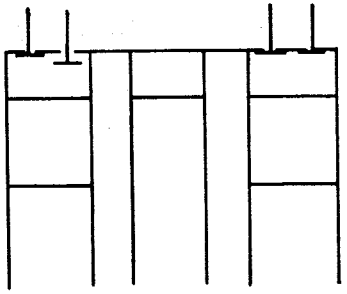
Figure 21A:
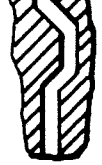
Figure 21B:
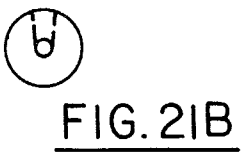

FIG. 21 shows the position of the pistons and the valves after the pistons have completed their up stroke and have just started their down stroke. The cam slot which is shown in FIG. 20A causes the rotary valve which is shown in FIG. 20B to turn to a port which leads from the top of the air pumping cylinder to the top of the right hand cylinder. This will permit hot compressed air to spurt from the top of the air pumping cylinder to the top of the right hand cylinder in which an air and fuel mixture has been compressed. This will create turbulence in these gases and ignite these gases. The cam slot, FIG. 21A will then cause the rotary valve to turn to the intake position as shown in FIG. 16B and the cycle will repeat itself.

It should now be apparent why the cylinders are arranged in pairs in which pistons are operated in tandem. This arrangement makes it possible to have one set of linkages and one air pumping cylinder take care of two cylinders.

I claim:

1. An apparatus for adjusting a piston stroke while maintaining constant compression ratio comprising:

A pair of tandem pistons;

A pair of first connecting rods, each having opposite ends, one end being connected to a respective one of said pistons;

A second connecting rod having an inverted U shape with a base and free parallel ends, with the base of said second connecting rod being connected to an end opposite said one end of each of said first connecting rods via a first shaft;

A U shaped arm comprising a base and parallel legs extending from said base with a portion of the legs adjacent the base of the U shaped arm being connected to the ends opposite said base of said second connecting rod via a second shaft;

A control arm being connected at one end thereof to a top portion of the legs of said U shaped arm along a pivot point, said control arm having means to vary said pivot point along a circular arc to maintain a constant compression ratio;

An air pumping piston located adjacent said pair of tandem pistons for injecting a flow of air thereto, and being connected via linkage means to said second shaft;

A rotary valve means located above said air pumping piston to control the air flow such that said tandem pistons are alternately fed air, said rotary valve being operated off of an overhead cam shaft via a reciprocating rack and pinion gearing.

* * * * *